US007214149B1

(12) United States Patent
Nowitzky et al.

(10) Patent No.: US 7,214,149 B1
(45) Date of Patent: May 8, 2007

(54) METHOD FOR PLAYING A TABLE TENNIS GAME AND PLAYING TABLE

(76) Inventors: Eric Nowitzky, 1925 Long Ridge Rd., Chesapeake, VA (US) 23322; Alfred Wright, 2017 Elbow Rd., Chesapeake, VA (US) 23320; James Boyette, 536 W. Saint Brides Rd., Chesapeake, VA (US) 23322

( * ) Notice: Subject to any disclaimer, the term of this patent is extended or adjusted under 35 U.S.C. 154(b) by 9 days.

(21) Appl. No.: 11/269,389

(22) Filed: Nov. 8, 2005

(51) Int. Cl.
*A63B 67/04* (2006.01)

(52) U.S. Cl. ..... 473/496

(58) Field of Classification Search ..... 473/496, 473/474, 475
See application file for complete search history.

(56) References Cited

U.S. PATENT DOCUMENTS 2,911,217 A * 11/1959 Block et al. ..... 473/435
3,622,156 A * 11/1971 Pugsley ..... 473/496
3,760,456 A * 9/1973 Mark ..... 16/223
4,108,434 A * 8/1978 Royer ..... 473/475
4,335,877 A * 6/1982 Long ..... 473/475
4,522,395 A * 6/1985 Arndt ..... 473/475
4,772,018 A * 9/1988 Inniger ..... 473/475
2004/0005941 A1* 1/2004 Chen ..... 473/496

FOREIGN PATENT DOCUMENTS

DE 38 00 430 A1 * 7/1989

* cited by examiner

*Primary Examiner*—Raleigh W. Chiu
(74) *Attorney, Agent, or Firm*—Goldizen & Associates; Bradley D. Goldizen

(57) ABSTRACT

The present invention is a game and table for playing table tennis with six players simultaneously. Each side of the table includes a pair of lobes formed by angled edges, having arcuate edges and being arranged on either side of a central region that defines a playing surface upon which a central player or center plays. Wingmen stand behind the arcuate edges and play on either side of the center.

7 Claims, 3 Drawing Sheets

METHOD FOR PLAYING A TABLE TENNIS GAME AND PLAYING TABLE

There are no related applications.

The patent application did not receive federal research and development funding.

BACKGROUND OF THE INVENTION

The invention is generally directed to a novel type of table for use in playing table tennis and a method for playing table tennis. More specifically, the invention is directed towards a table having an extended surface area and that contains two lobes on each side of the table that widens the table in a manner that allows for six players to play three-on-three table tennis. A plan view of the table shows that it is substantially hour glass shaped.

Table tennis is a popular game that is played throughout the world. Typically the game is played on a rectangular playing surface that is supported and lies in a horizontal plane above a floor. A net is arranged in the middle of the table to divide it into a pair of playing surfaces. Each of the pair of playing surfaces is divided into halves by a white line that runs parallel to the sides of the table and intersects the net in a perpendicular fashion while extending from one end of the table to the other. A white line extends along the edges and ends of the table. Ordinarily, the table is hinged by a pair of hinges such that the table may be easily stored.

A standard prior art table for playing table tennis is one hundred eight inches (108") long by sixty inches (60") wide. The length of the table is divided into halves by the net. Thus, the effective playing area for each player or two person team is fifty four inches (54") by sixty inches (60"). By maintaining each player fifty four inches away from the net, allows the average player the ability to stand at the edge of the table while adequately reaching the ball at the front of the playing area when a ball barely clears the net.

The prior art table may be used to play either singles or doubles. When playing singles, a player uses the entire playing surface of one side. When playing doubles, a pair of players divides the playing surfaces into equal parts and play the shots that enter their particular playing area, or the pair of players alternate turns playing the shots effectively playing a single player game with two players. The size of the playing surface is inadequate for facilitating the playing of three-on-three games of table tennis.

BRIEF SUMMARY OF THE INVENTION

The present invention is a uniquely shaped table for playing table tennis. The table is generally hour glass in shape when viewed in plan. Each side of the table comprises edges that form angles having vertexes which are centrally located between opposite ends of the table and near the net. A distance between the vertexes is approximately sixty inches (60") wide such that a standard net may be attached to the table. Arcuate edges are provided at opposite ends of each angled edge to connect the angled edges to the ends of the tables which include straight edges that are parallel to the net.

The table for playing three-on-three table tennis includes a flat playing surface comprising a first and second halves separated by a net. The first half comprises a pair of angled edges, a pair of arcuate edges and a straight edge. The first angled edge connects to the first arcuate edge at one end. The first arcuate edge attaches to the straight edge at an end opposite the first angled edge. The straight edge connects at an opposite end to the second arcuate edge. The second arcuate edge connects to the second angled edge at an end opposite the straight edge.

The second half comprises a pair of angled edges, a pair of arcuate edges, and a straight edge. The first angled edge connects to said first arcuate edge. The first arcuate edge attaches to the straight edge at an end opposite the first angled edge. The straight edge connects at an opposite end to the second arcuate edge. The second arcuate edge connects to the second angled edge at an end opposite the straight edge. The first angled edge of the first half connects at one end to the second angled edge of the second half to form a first vertex. The second angled edge of the first half connects at one end to the first angled edge of the second half to form a second vertex. A net attaches between the first and second vertexes. A support structure attaches to an underside of the flat playing surface for supporting the playing structure.

Other features provided may include a support structure comprising a plurality of wheels for easily moving the table. Hinges may be attached to each half such that one half may be folded onto the other half for storage purposes. Also, the flat playing surface may comprise a plurality of lines for designating an area of play for each player.

The game of three-on-three comprises two teams each having a center and two wingmen. The center plays behind the straight edge; whilst each wingman assumes a position behind respective arcuate edges on either side of the straight edge. During play, the wingmen should not step forward of the vertex created between the angled edge and the arcuate edge behind which they play to prevent an unfair playing advantage.

It is an object of the invention to provide a novel type of table tennis playing surface that allows six players to play table tennis simultaneously.

It is another object of the invention to provide a table that deters collisions between teammates and their paddles when playing three-on-three table tennis.

It is a further object of the invention to provide a table having a large enough playing surface for playing three-on-three table tennis that allows a center player to adequately reach the net.

It is a further object of the invention to provide a table for playing table tennis that minimizes unfair acute angle returns.

It is another object of the invention to provide a table for playing table tennis that provides a larger playing surface than a standard table while allowing for fair shots and eliminating cheap shots such that a three-on-three game of table tennis may be played fairly.

Additional objects and advantages of the invention will be set forth in part in the description that follows, and in part will be obvious from the description, or may be learned from practicing the invention. The objects and advantages of the invention will be obtained by means of instrumentalities in combinations particularly pointed out in the appended claims.

DETAILED DESCRIPTION OF THE INVENTION

Figure 1:
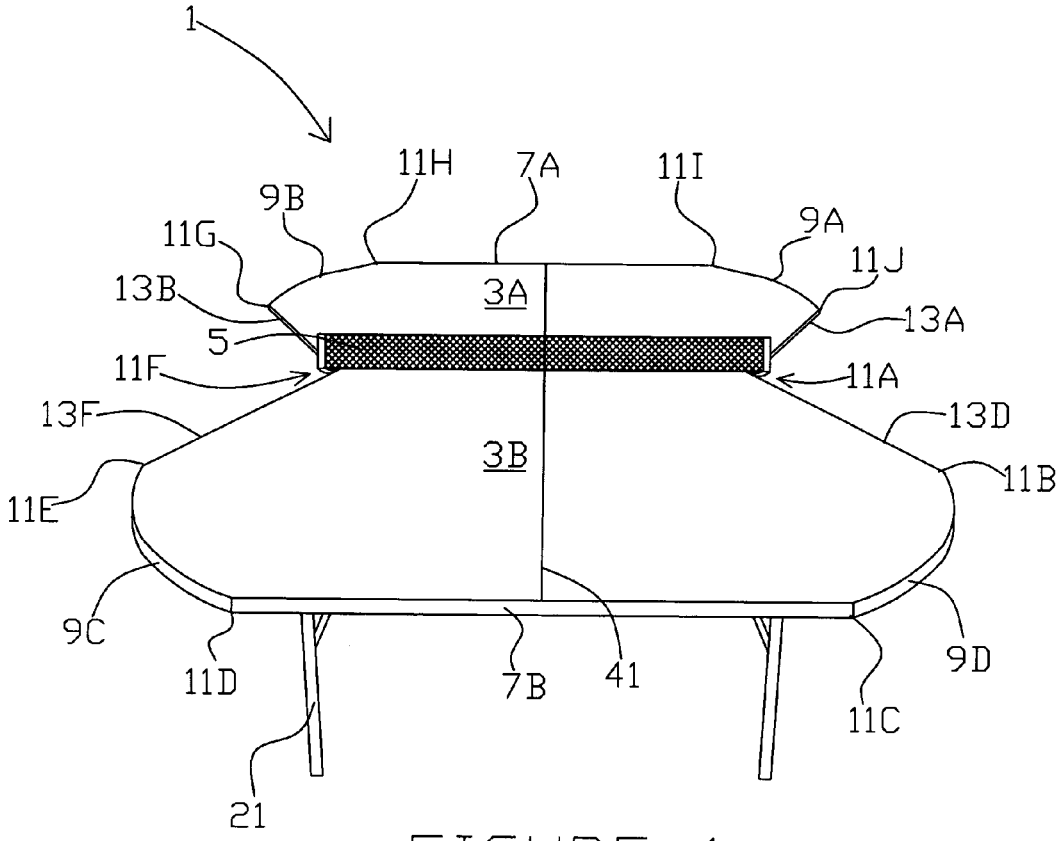
FIG. 1 is a perspective view of the table of the present invention shown from an end.
Figure 2:
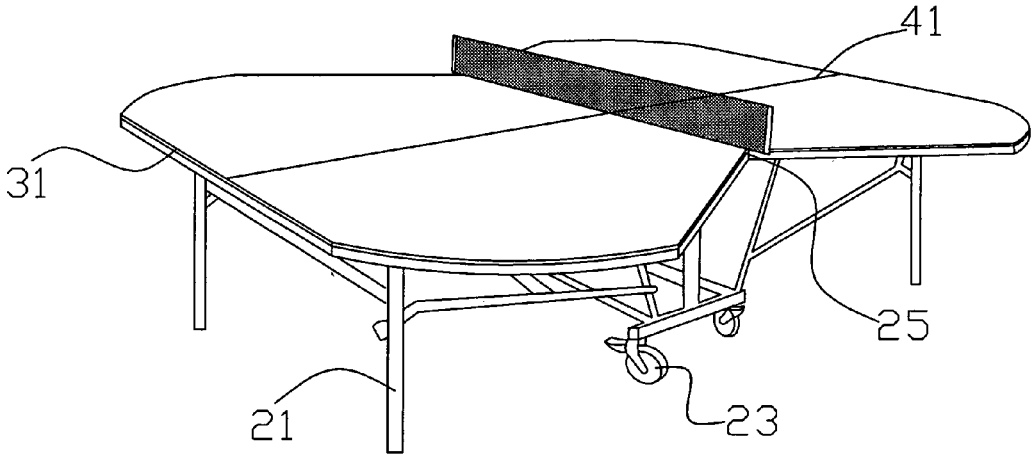
FIG. 2 is a second perspective view of the table shown from behind an arcuate surface.
Figure 3:
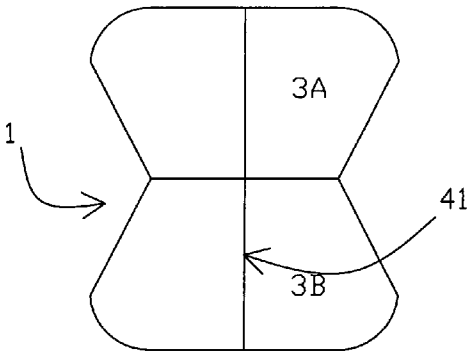
FIG. 3 is a plan view of the table shown from above.

FIGS. 1 through 3 depict the table 1 of the present invention. The table 1 comprises two straight edges 7A and 7B behind which a center player on each team plays the three-on-three game of table tennis. Each side 3 comprises a plurality of vertices 11A through 11F. Angled edges 13A through 13D extend from central vertices 11A and 11F, and terminate at vertices 11B, 11E, 11G and 11J, respectively. Two pair of arcuate edges 9A through 9D connects the angled edges 13 to straight edges 7. A single wingman plays behind each of the arcuate edges 9. A net 5 stretches between vertices 11A and 11F. The table 1 includes a support structure 21 upon which the playing surfaces comprised of sides 3 rests.

Support structure 21 may include wheels 23 for easily moving table 1 around. Sides 3A and 3B connect together via hinge 25 such that one side may be folded onto the other for storage purposes after the net 5 is removed. Net 5 may be attached to table 1 in a known manner. Line 41 is provided down the center of the table for aiding the players in determining service areas.

Figure 4A:
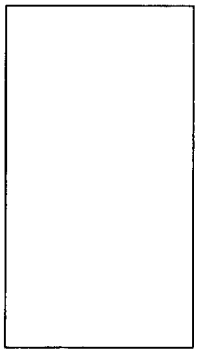
FIGS. 4A through 4D are different shaped tables.

FIGS. 4A through D show other types of tables which were used in attempting to play the game of three-on-three table tennis. FIG. 4A shows a prior art table for playing table tennis. In this instance, the game is played with the three players on each side rotating. The game may be played by alternating the players on one team. This means that two players cover one side of the table simultaneously while the third player steps out of the way to allow the others to play. One of the two players then switches with the third player to allow him to play the game. This requires much attention to the game and quick switching between the playing and non-playing players in order to maintain a smooth transition.

Figure 4B:
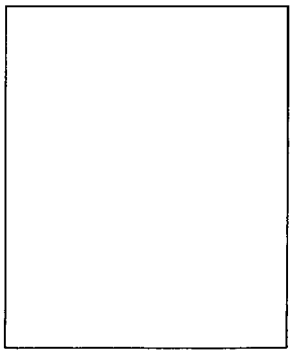

Another contemplated shape of the table is a wider table as shown in FIG. 4B. The wider table is inadequate for use in doubles or singles because the width of the table is difficult to cover when either doubles or singles are played. Moreover, this type of table leads to some fairly simple shots that can be made at such a small angle relative to the net that the difficulty of the game is increased and the excitement is reduced.

Figure 4C:
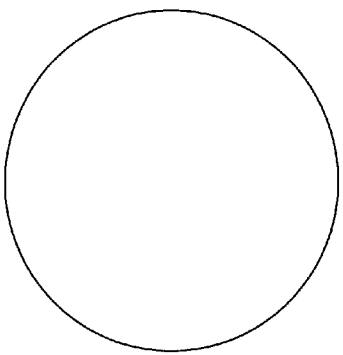

A further contemplated shape of the table is round, as shown in FIG. 4C. One problem associated with a round table is that players are allowed to play closer to the net. Playing close to the net allows for easy "slam" shots. A "slam" shot occurs when the ball is hit hard against the table often resulting in an easy score and thereby reducing the excitement of the game that is generated when a long volley of the ball is conducted between the teams.

Figure 4D:
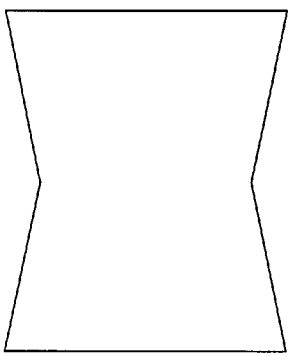

A hexagon table as shown in FIG. 4D was also contemplated. However, this creates a problem in that the players are playing too close to one another resulting in missed shots and interference between players. In this instance, it is very difficult to move out of another player's way. Thus, the table shown in FIGS. 1 through 3 is superior to each of the tables shown in FIGS. 4A through 4D for playing three-on-three table tennis.

Method of Playing Three-on-Three Table Tennis

The game is started by having a wingman serve the ball. The serve is started with the ball resting freely on the open palm of the server's stationary free hand. The server then projects the ball near vertically upwards and then falls without touching anything before being struck by the server's paddle. The ball must then hit the serving wingman's quadrant of the table and bounce over the net striking the quadrant of the table opposite of him.

Any player of the other team must then make a good return by hitting the ball over the net such that it strikes the table anywhere on the opposing teams playing surface. The ball is continuously hit back and forth between the teams until a good return cannot be made. A point is scored by the last team to make a good return.

The ball is always served cross-court by a wingman. The wingman who starts the game serves the ball consecutive for five serves. After five serves then the wingman on the other team opposite of that wingman will serve five consecutive points. Then the serve goes back to the original serving team's other wingman for five consecutive serves. Next, the opposite team's remaining wingman will serve five consecutive points. This manner of changing servers repeats until the game is over.

A game is won by attaining 21 points. A team must win by 2 points. A match consists of the best of any odd number of games. Play is continuous throughout, except for authorized intervals.

It is to be understood that the invention is not limited to the exact construction illustrated and described above. Various changes and modifications may be made without departing from the spirit and the scope of the invention as defined in the following claims.

We claim:

1. A table for playing three-on-three table tennis, said table having a flat playing surface comprising:

a first half comprising a first angled edge, a second angled edge, a first arcuate edge, a second arcuate edge and a straight edge, said first angled edge connected to said first arcuate edge, said first arcuate edge attached to the straight edge at an end opposite the first angled edge, said straight edge being connected at an opposite end to the second arcuate edge, said second arcuate edge connected to the second angled edge at an end opposite the straight edge;

a second half comprising a first angled edge, a second angled edge, a first arcuate edge, a second arcuate edge and a straight edge, said first angled edge connected to said first arcuate edge, said first arcuate edge attached to the straight edge at an end opposite the first angled edge, said straight edge being connected at an opposite end to the second arcuate edge, said second arcuate edge connected to the second angled edge at an end opposite the straight edge, said first angled edge of the first half being connected at one end to the second angled edge of the second half to form a first vertex, said second angled edge of the first half being connected at one end to the first angled edge of the second half to form a second vertex;

a net attached between said first and second vertexes; and, a support structure attached to an underside of the flat playing surface for supporting the playing structure.

2. The table of claim 1 wherein said support structure comprises a plurality of wheels.

3. The table of claim 1 wherein said flat playing surface comprises a single line designating an service area for each wingman.

4. A table for playing three-on-three table tennis, said table having a flat playing surface comprising:

a first half comprising a first angled edge, a second angled edge, a first arcuate edge, a second arcuate edge and a straight edge, said first angled edge connected to said first arcuate edge, said first arcuate edge attached to the straight edge at an end opposite the first angled edge, said straight edge being connected at an opposite end to the second arcuate edge, said second arcuate edge connected to the second angled edge at an end opposite the straight edge;

a second half comprising a first angled edge, a second angled edge, a first arcuate edge, a second arcuate edge and a straight edge, said first angled edge connected to said first arcuate edge, said first arcuate edge attached to the straight edge at an end opposite the first angled edge, said straight edge being connected at an opposite end to the second arcuate edge, said second arcuate edge connected to the second angled edge at an end opposite the straight edge, said first angled edge of the first half being connected at one end to the second angled edge of the second half to form a first vertex, said second angled edge of the first half being connected at one end to the first angled edge of the second half to form a second vertex;

a net attached between said first and second vertexes;

a support structure attached to an underside of the flat playing surface for supporting the playing structure; and hinges attached to each half such that one half may be folded onto the other half for storage purposes.

5. The table of claim 4 wherein said support structure comprises a plurality of wheels.

6. The table of claim 4 wherein said flat playing surface comprises a plurality of lines for designating an area of play for each player.

7. A method for playing three-on-three table tennis comprising:

providing a table having two sides separated by a net, each side comprising a pair of arcuate edges connected together by a straight edge, angled edges connecting to each arcuate edge opposite the straight edge, each angled edge forming a vertex with an angled edge of the opposite side;

providing a center player who plays behind the straight edge;

providing two wingmen each playing behind one of the arcuate edges;

serving a table tennis ball from one side to the other; and, returning the serve to the side of the table from which the serve was served.

* * * * *